US007578221B2

(12) United States Patent
Billingsley

(10) Patent No.: US 7,578,221 B2
(45) Date of Patent: Aug. 25, 2009

(54) METHOD AND APPARATUS FOR ADJUSTABLE CUTTING OF A FILAMENTARY MATERIAL

(75) Inventor: John G. S. Billingsley, J.G.S. Billingsley, Inc., 110 Briar La., Newark, DE (US) 19711-3104

(73) Assignee: John G. S. Billingsley, Newark, DE (US)

( * ) Notice: Subject to any disclaimer, the term of this patent is extended or adjusted under 35 U.S.C. 154(b) by 550 days.

(21) Appl. No.: 10/558,974

(22) PCT Filed: Jun. 3, 2003

(86) PCT No.: PCT/US03/17272

§ 371 (c)(1),
(2), (4) Date: Dec. 1, 2005

(87) PCT Pub. No.: WO2004/108998

PCT Pub. Date: Dec. 16, 2004

(65) Prior Publication Data

US 2007/0089575 A1 Apr. 26, 2007

(51) Int. Cl.
*B26D 3/22* (2006.01)

(52) U.S. Cl. ..... 83/39; 83/402; 83/913; 83/950

(58) Field of Classification Search ..... 83/402, 83/699.41, 913, 950, 39, 42
See application file for complete search history.

(56) References Cited

U.S. PATENT DOCUMENTS 2,173,789 A * 9/1939 Nikles et al. ..... 83/22
2,217,766 A * 10/1940 Neff ..... 83/402
2,570,466 A * 10/1951 MacHenry ..... 83/913
2,846,004 A * 8/1958 Fotland ..... 83/402
2,887,155 A * 5/1959 Keefe, Jr. ..... 83/15
3,119,294 A 1/1964 Billingsley et al.
3,334,532 A * 8/1967 Mylo ..... 83/913
3,367,222 A * 2/1968 Mummery ..... 83/913
3,640,163 A * 2/1972 Giardini et al. ..... 83/53
3,693,487 A * 9/1972 Murdock et al. ..... 83/913
3,717,060 A * 2/1973 McGill ..... 83/403
3,800,642 A * 4/1974 Hasler et al. ..... 83/913

(Continued)

FOREIGN PATENT DOCUMENTS

JP 63222038 A * 9/1988

(Continued)

*Primary Examiner*—Jason Daniel Prone
(74) *Attorney, Agent, or Firm*—Connolly Bove Lodge & Hutz LLP

(57) ABSTRACT

A cutting apparatus for continuous lengths of filaments bundles, film ribbons, filamentary-type or other material in strip like form is disclosed containing a tube that is readily adjustable in very small increments relative to rotating blades. A housing surrounds the exit end of the tube and rotating blades which is attached to a suction device. The device creates a high velocity flow of air through the tube which aligns the filamentary material for cutting. An insert may be placed in the tube which contains an upper surface or anvil at its outer end. The tube and/or the insert in the tube is adjustable in two dimensions relative to one or more blades rotating in a plane transverse to the axis of the tube. These adjustments which may be made during operation of the cutting process to facilitate a cleaner, uniform cutting of the filamentary material.

17 Claims, 3 Drawing Sheets

U.S. PATENT DOCUMENTS

| | | | | | |
|---|---|---|---|---|---|
| 3,831,482 | A | | 8/1974 | Eichler et al. | |
| 3,857,309 | A | * | 12/1974 | Bradley et al. | 83/402 |
| 4,009,629 | A | * | 3/1977 | Thomas et al. | 83/913 |
| 4,019,414 | A | * | 4/1977 | Thomas et al. | 83/913 |
| 4,048,884 | A | * | 9/1977 | Winn, Jr. | 83/402 |
| 4,090,425 | A | * | 5/1978 | Platt | 83/402 |
| 4,188,845 | A | | 2/1980 | Stukenberg | |
| 4,343,069 | A | * | 8/1982 | McLuskie et al. | 83/913 |
| 4,389,774 | A | * | 6/1983 | McLaughlin, Jr. | 83/100 |
| 5,078,032 | A | * | 1/1992 | Gerlach | 83/950 |
| 5,450,777 | A | | 9/1995 | Molnar et al. | |
| 5,836,225 | A | | 11/1998 | Molnar et al. | |
| 5,850,773 | A | * | 12/1998 | Burns | 83/950 |
| 5,921,160 | A | * | 7/1999 | Yankaitis et al. | 83/950 |
| 6,182,332 | B1 | * | 2/2001 | Jander | 83/913 |
| 6,209,432 | B1 | * | 4/2001 | Matsuda | 83/950 |
| 7,252,026 | B2 | * | 8/2007 | Kempski et al. | 83/913 |
| 2002/0069732 | A1 | * | 6/2002 | Waggoner et al. | 83/913 |

FOREIGN PATENT DOCUMENTS

| | | | |
|---|---|---|---|
| JP | 06287817 | A * | 10/1994 |

* cited by examiner 10
12
14
15
16
18
20
22
24
26
28
30
32
38
40
42
43
44
50
52
54
56
62

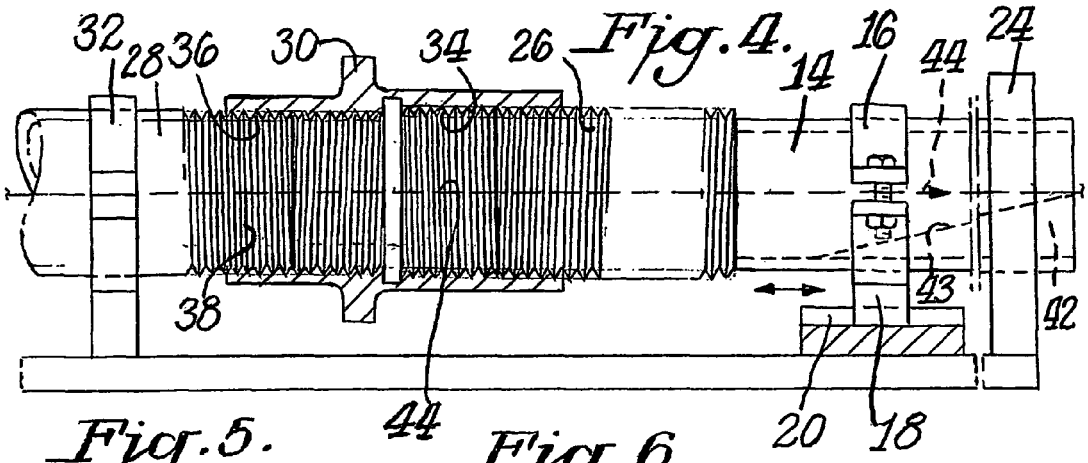
Fig. 4.
Fig. 5.
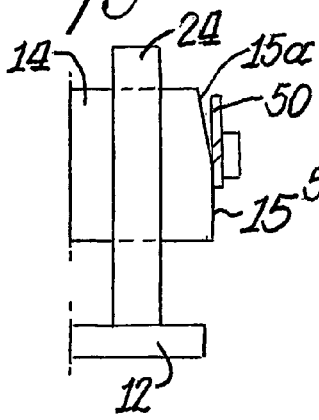
Fig. 6.
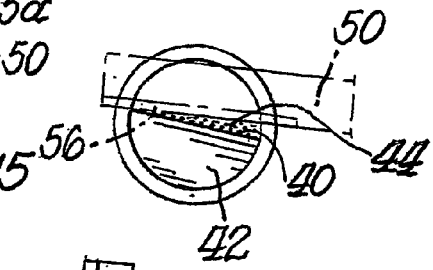
Fig. 7.
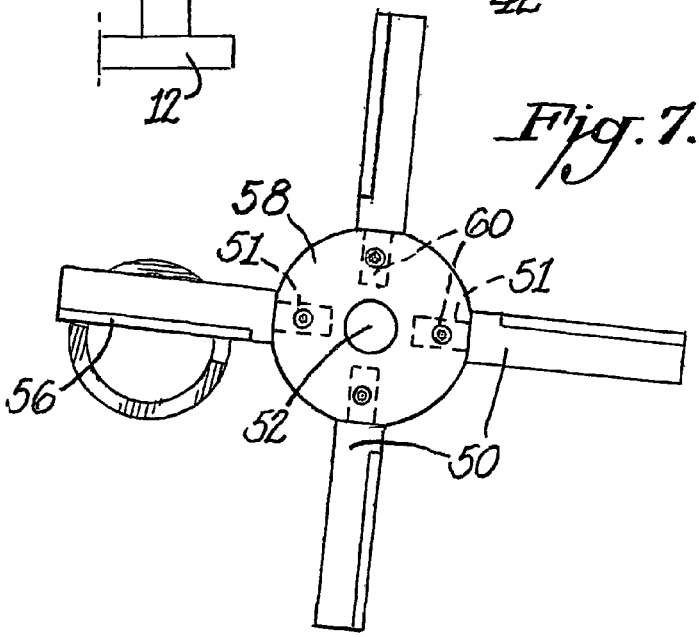

METHOD AND APPARATUS FOR ADJUSTABLE CUTTING OF A FILAMENTARY MATERIAL

BACKGROUND OF THE INVENTION

A. Field of Invention

The dependable and accurate cutting of moving and continuous lengths of filament bundles, film ribbons, filamentary tapes or other materials in strip-like form is a challenging and difficult problem, particularly so when the ribbon thickness or the diameter of the filaments is only a few microns.

Such materials have no appreciable stiffness and must be conveyed and aligned by a moving stream of air, feed rolls or other mechanical means or by air jets, or a combination of these, to the cutting location, where it is cut into discrete lengths, the length being determined by dividing the material transport speed by the number of cuts/minute. Fixing these two parameters when cutting filaments, into staple or flock, or ribbons will result in the desirable, uniform length product.

In scrap recovery or disposal systems, where uniform cut length is of little concern, cutting speed is normally fixed but cut length will vary with the changing speed of the process and a random length product results.

B. Description of the Related Art

Various approaches to uniform cutting of such fibers or film have been described in the prior art. U.S. Pat. No. 3,119,294 issued Jan. 28, 1964 describes a cutting apparatus in which counter-rotating rolls feed a filamentary material into an air nozzle which terminates at a stationary bed knife. A mating blade mounted on a rapidly rotating shaft cuts the filamentary material as it exits the air nozzle. See column 2, lines 23-32 and FIG. 1. This patent describes an elaborate mechanism to maintain a uniform distance between rotating cutting blade and stationery bed knife. Satisfactory cutting of the feed filaments or ribbon requires that the distance between these two elements be only a fraction of the diameter of the filaments or of the ribbon to be cut. Maintenance of this distance insures a uniform length of the cut filamentary material and long life for the cutting blades (column 4, lines 17-21). That mechanism, however, is a very complex piece of machinery with expensive precision parts that are costly and requires substantial expertise to adjust.

U.S. Pat. No. 3,831,482 issued Aug. 27, 1974 discloses an apparatus for cutting fiber into staple fiber strands. It consists of a rotating two-part disc with discardable knife blades clamped between the disc halves. The stated advantage of this arrangement is that it "eliminates the need for a removal and replacement of knives for re-grinding" (Column 2, lines 33-36). There is no disclosure of means for adjusting the length of cut fibers or apparatus associated with the cutting blades to adjust the length of the cut fiber.

Another approach to cutting filamentary material is illustrated in commonly assigned U.S. Pat. Nos. 5,450,777 and 5,836,225. These patents describe apparatus for cutting lengthy continuous tows of fiber into short, chopped fiber. This goal is accomplished by feeding multiple tows into a venturi tube which pulls the tows by negative pressure toward a cutter at the outlet of the tube. The cutter mechanism has one or more blades mounted to a high-speed drive shaft which operate in a plane transverse to the direction of movement of the tow. As the blades rotate near a cutter plate at the exit of the venturi tube, the tow fibers are cut into uniform lengths as the blade passes across the cutter plate. The cross sectional area of the cutter plate opening is such that it is momentarily covered (blocked) by the cutting blade as it rotates across the plate (See FIG. 8 of '225 patent). This arrangement tends to create a lot of high frequency noise as the air stream exiting the venture tube is repeatedly interrupted.

A similar approach to cutting filamentary material is described in U.S. Pat. No. 4,188,845 issued Feb. 19, 1980. In this arrangement, the material to be cut includes foils, plastic webs, etc., (See column 1, lines 7-9) and textile strips (See column 2, line 61). This material enters a funnel mounted atop a stationary cutting plate at the narrow end of the funnel. It proceeds through the funnel by gravity without assistance of the venturi effect described above. Rotating beneath the stationary cutting plate are multiple knife edges mounted vertically (in the plane of the foil or fiber flow) on a disc rotating below the stationary cutting plate. The knife edges are preferably adjustable to insure sliding engagement of the knife edges over the cutting plate, which is also adjustable.

Yet another approach to cutting fiber into fixed lengths for use as reinforcement in, for example, roofing shingles, is illustrated and described in U.S. Pat. No. 6,182,332 B1 issued Feb. 6, 2001. In this patent, several rotating discs with sharp edges are moved in orbit relative to a second member such as a ring with an internal track. The fiber to be cut passes between the sharp edges of the disc and internal track where it is cut. The length of the fiber to be cut is determined by adjusting the rate at which the continuous fibers are fed to the cutters and the speed at which the cutting discs are moved in orbit within the internal track (column 5, lines 23-35).

SUMMARY OF THE INVENTION

The current invention provides a simplified means for directing continuous lengths of film and/or fiber through a transport tube into a rotating cutter and, uniquely, of adjusting the clearance between the stationary cutting surface and the moving knife or knives to provide optimum cutting conditions while the cutting machine is in the operating mode. The stationary cutting surface, because of the versatility inherent in the design, can range from a transport tube to a cutting surface fixed at some chord within the transport tube. The design avoids the need for the heavy and expensive apparatus of U.S. Pat. No. 3,119,294, while functionally achieving improved operating flexibility and equivalent cutting capability at much lower cost. Air is drawn through the transport tube by a suitable suction device to align the continuous lengths of fiber or film within the transport tube to the point of cutting where one or more rotating blades traverse the exit end of the tube at high speed to cut the exiting filament, tape or film into suitable lengths, and to convey the cut material to some collection point.

This invention provides simplified means for adjusting the distance and orientation of the rotating blades and surfaces on or in the tube that interact to cut the material. In one embodiment, the cutting edge of the rotating blades clears a slightly tapered upper portion of the tube end which transitions into a vertical outer surface where cutting occurs. In another embodiment, an insert with a sloped inner face, such as a tapered section of a right cylinder, which terminates in a suitable cutting surface, is placed at one end of the tube to improve guidance of the film or fiber as it approaches the cutting blades at the exit end of the tube. The insert reduces the tube's exit area which increases air velocity. That increased velocity improves the alignment of the filament, film or tape as they approach the cutting blades.

The upper surface of the insert acts as an anvil against which the rotating cutting blades pass as they cut the fibers or film exiting the tube. Cutting blades are mounted on a rotating shaft, the axis of which is parallel to the tube. The cutting assembly is counter balanced by judicious placement of the blades, when two or more are used or by a counter weight when a single blade is used.

The insert in the tube, or the tube itself, may be oriented about the axis of the tube so that the anvil portion of the insert at the tube exit may be angularly adjusted relative to the leading edge of the blade passing over the anvil. It has been found that having an approach angle between the upper surface of the anvil in the tube insert or of the non-tapered portion of the transport tube, and the leading edge of the cutter blades improves cutting. This angling of the stationary cutting surface to the moving cutter blades reduces the amount of filament, tape or film being cut at any one time, thereby achieving both a reduced cutting load and a significantly lower cutting noise.

The gap between the face of the tube and the leading edge of the cutting blade is adjustable in very small increments through the use of a unique adjustment means associated with the tube through which the filamentary material is fed. This is accomplished with a differential screw arrangement consisting of an adjustment ring with (1) internal screw threads of one hand and pitch mating with external threads on the tube containing the insert and (2) with internal threads of the opposite hand and a different pitch mating with external threads on a stationary upstream feed conduit. As the adjustment ring is rotated in one direction, the tube moves toward the cutting blades a distance equal to the difference in the pitch of the two external threads, times the degrees of rotation divided by 360 degrees. For example, a 10° rotation of the adjustment ring with external thread pitches of 20 and 22 will advance the tube only one ten thousands of an inch ("0.0001") toward the cutting blades. Conversely, rotation of the adjustment ring in the other direction will move the tube away from the cutting blades.

This simple, but effective, fine adjustment arrangement facilitates ready operation of the disclosed cutting system by relatively unskilled operators. The operator need only rotate the adjustment ring a small amount to accommodate erosion of the cutting surface on or in the tube. This easy adjustment facilitates an empirical evaluation of the cutting as it takes place, i.e., the adjustment ring can be rotated thereby advancing the tube in a direction toward the blades until a suitable cut fiber or film exits the tube. In addition, the tube, with or without an insert, can be incrementally advanced toward the rotating blades to shave microscopically thin slices of material from the edge of the insert or of the tube, thereby removing the eroded or worn surfaces of that edge. This re-establishes a sharp cutting edge and the close cutting clearance deemed best for effective cutting of the material.

The area surrounding the cutting is easily isolated in this system for safety and noise reasons. Because the alignment of the axes of the cutting blade drive shaft and tube is parallel, it is easy to mount a protective hood over the rotating blade and the area where the film or fiber exits the tube. A suction device attached to the protective hood draws the fiber, tape or other filamentary material to, and through, the cutting apparatus. The suction device preferably generates air velocity in the tube sufficient to both keep the film or filaments relatively straight at the cutting point and to effectively and efficiently convey the cut material to the collection point. Conveying velocities for transporting lightweight material in this fashion typically range between 3500-5000 feet per minute (approx. 40-60 miles per hour). High velocities in the tube tend to pull the material through the center of the tube and stiffen the otherwise flexible material being cut. This straight alignment of material presents the material in a preferred orientation for cutting by the rotating blades passing in front of the tube exit. When the insert is used in the tube, the exit velocity of air through the tube is increased because of the smaller tube outlet area. This further enhances the stiffness and alignment of the material relative to the rotating blades. The materials of the tube, of the upper surface of the insert and of the moving knives, are selected to be compatible with each other and with the materials to be cut. The moving knives are always the hardest.

BRIEF DESCRIPTION OF THE DRAWINGS

FIG. 4 is a partial cross-sectional view in elevation showing the tube adjusting mechanism;

FIG. 5 is a fragmental side elevational view of the cutting tube having an upper tapered end;

FIG. 6 is a right side elevational view of the cutting tube showing the end of the tube insert;

FIG. 7 is a right side elevational view showing the cutting tube with tapered edge and multiple cutting blades passing over the tapered edge.

DESCRIPTION OF THE PREFERRED EMBODIMENTS

Figures 1, 2, 3:
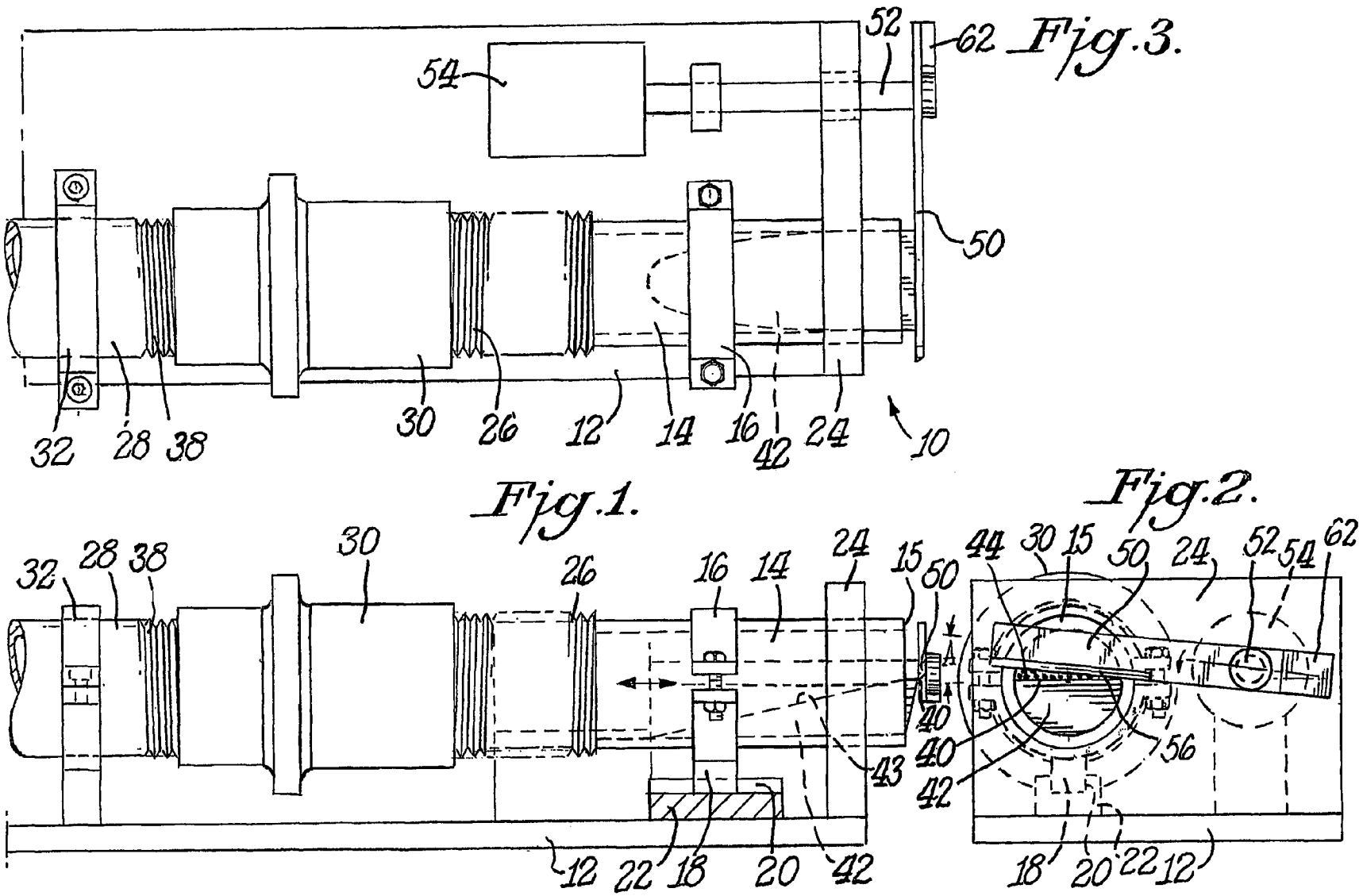
FIG. 1 is a side elevational view of the fiber, tape and film cutting apparatus of this invention.
FIG. 2 is a right side elevational view of the apparatus of FIG. 1.
FIG. 3 is a top plan view of the apparatus of FIG. 1.

Some elements of one presently preferred embodiment of the apparatus 10 of this invention are illustrated in FIGS. 1-3. More particularly, a base 12 forms a foundation for mounting an adjustable tube 14 thereon. A clamp 16 affixed to the outer surface of tube 14 contains a guide pin 18 extending from one or more portions of the clamp 16 to prevent rotation of tube 14. The guide pin 18 is free to move longitudinally in slot 20 in a U-shaped guide 22 mounted on base 12. Thus, while guide pin 18 prevents rotation of tube 14, that pin does allow travel of the tube 14 along the longitudinal axis of the tube as it slides in the slot 20 in U-shaped guide 22.

A mounting bracket 24 holds tube 14 in position relative to base 12 and the adjacent shaft 52 of cutting apparatus described more fully below. A small clearance between the outside circumference of tube 14 and the inside of a bore in bracket 24 permits longitudinal movement of tube 14 with minimum vibration or chatter as the cutting takes place.

The outer circumference of tube 14 furthest from the cutting contains threads 26. This threaded end 26 of tube 14 is coupled to a feed conduit 28 via an adjusting ring 30. This feed conduit 28 is fixed to base 12 with clamp 32. This clamp 32 holds feed conduit 28 in alignment with tube 14 and prevents movement, either rotationally or longitudinally, of feed conduit 28.

Fine adjustment of tube 14 in a direction along the longitudinal axis is possible by a slight rotation of adjusting ring 30. As shown in FIG. 4, tube 14 has external threads 26, which mate with like internal threads 34 in adjusting ring 30. Internal threads 36 on adjusting ring 30 likewise mate with external threads 38 on feed conduit 28. A very fine adjustment of tube 14, for example 0.0001 inches, in a longitudinal direction is possible by very little (10°) rotation of adjustment ring 30. More specifically, if external threads 26 on tube 14 have a pitch of 20 threads per inch and the external threads 38 on feed conduit 28 have a pitch of 22 threads per inch, a 10° rotation of adjusting ring 30 will move the end of tube 14 about one-ten thousands of an inch (0.0001").

Longitudinal adjustment of tube 14 is important for all of the reasons explained in U.S. Pat. No. 3,119,294, namely, wear on the stationary part of the cutting apparatus which changes the gap between cutting blades and that stationary part. Variation in that gap can affect the cutting capability of the cutting apparatus. In one embodiment of this invention, the stationary part of the cutting apparatus has an edge or anvil 40 as part of a sloped insert 42 in tube 14 (See FIG. 1). This edge 40 may extend a small distance, typically ⅛" to ¼', beyond the front face 15 of tube 14 as shown in FIG. 1.

Insert 42 has a sloped surface 43 within tube 14 which directs the fiber or film 44 being cut to a position just above anvil 40 at the time it is cut. (See FIG. 6). The sloped surface 43 of insert 42 also accomplishes an accelerated flow of air though tube 14 which improves the handleability of filamentary material 44, especially very thin, filamentary material. Alternatively, an upper portion 15*a* of the front face 15 of tube 14 may be slightly tapered as shown in FIGS. 5 and 7 to direct the cutting blade to pass immediately adjacent the front face of tube 14.

Cutting blades 50 are mounted on a shaft 52 driven by motor 54 (FIG. 3). As shaft 52 is turned, the leading edge 56 of blade 50 passes across the front face 15 of tube 14 and cuts material 44 exiting tube 14. As mentioned above, tube 14 is adjustable in its longitudinal direction so that the leading edge 56 of blade 50 is always at the proper distance from the vertical portion of face 15 or from the edge 40 of insert 42 of tube 14 to insure a clean cut.

The ability of this apparatus 10 to cut filamentary material is also enhanced by the ability to adjust the angle at which the leading edge 56 of blades 50 approaches the material 44 in tube 14. When insert 42 with edge 40 is used, it can be angled relative to the leading edge 56 of blade 50. That angle is illustrated in FIG. 2 as "A" and is the angle between a line drawn through the center line of shaft 52 to the outside edge of blade 50 and a line extending along the top surface of anvil 40. This angle of approach of leading edge 56 of blade 50 to the upper surface of anvil 40 can be adjusted by rotating insert 42 within tube 14 and then fixing it in place after the optimum angle "A" is determined by empirical analysis or other means. See FIG. 6 for another orientation of insert 42 relative to leading edge 56 of blade 50. Where insert 42 is not used, tube 14 can also be oriented relative to the leading edge 56 of blade 50 by rotation of tube 14 in clamp 16 as shown in FIG. 7.

Blades 50 are preferably held in place by hub 58 mounted on shaft 52. As illustrated in FIG. 7, the blades 50 have shanks 51 which are held in hub 58. If the shanks 51 are circular in cross-section, the blades 50 can be rotated in the hub 58 so that the angle of approach to material exiting tube 14 can be adjusted through a wide range. The number of blades 50 is preferably an even number, for example 2 or 4, so that these counterbalance each other as shown in FIG. 7. However, a single blade may be used with a suitable counterweight 62 as shown in FIG. 2. Where multiple blades are used, it is important that they are all aligned in the same plane. To make such alignment, a reference plate 74 can be mounted in housing 70. Each blade 50 can then be pressed against plate 74 and set screws 60 tightened to assure uniform alignment of the blades.

Figure 9:
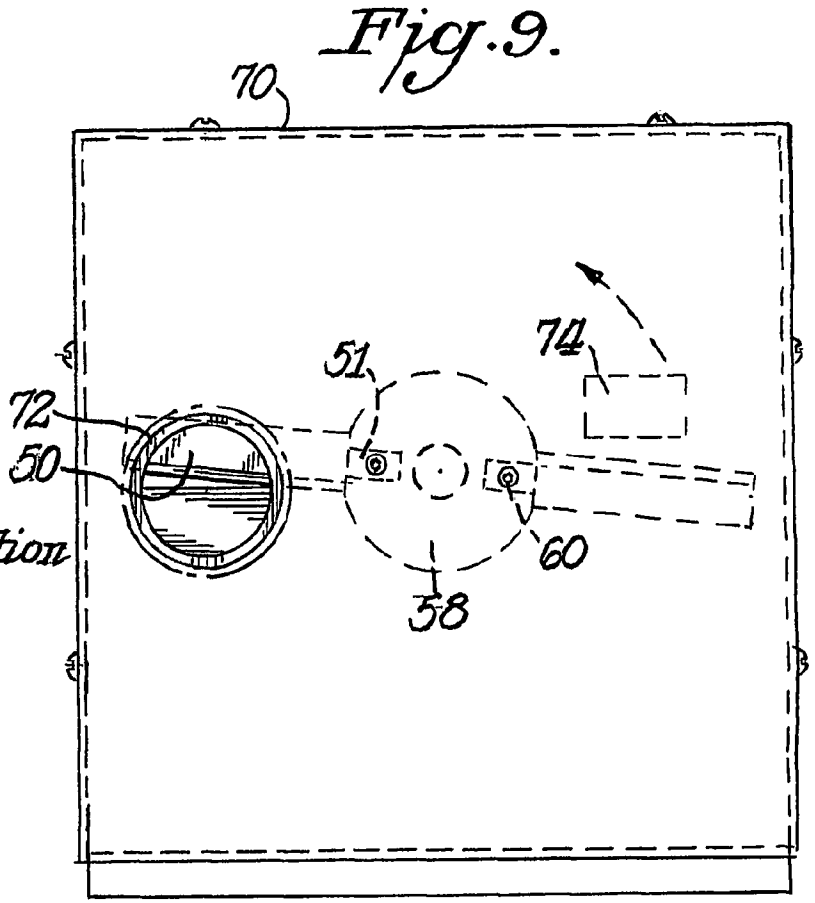
FIG. 9 is a right side elevational view of the apparatus of FIG. 8.
Figure 8:
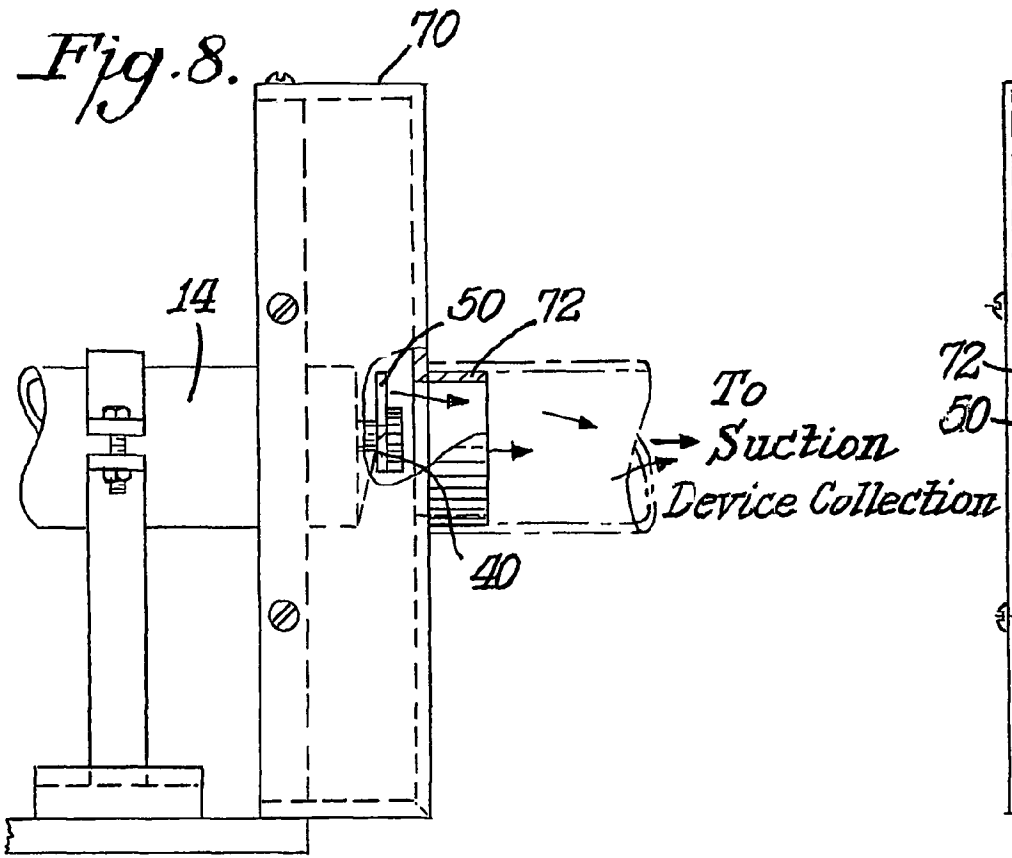
FIG. 8 is a side elevational view partially cut away of the cutting apparatus illustrating a protective housing around the rotating blades attached to a suction device.

In operation fiber, tape or film 44 is introduced into feed conduit 28 and pulled through tube 14 by high speed air. Air movement through tube 14 is created by a suction device (not shown) attached to a housing 70 surrounding the outlet end of tube 14 (See FIGS. 8 and 9). The inlet side of the suction device is connected to a duct 72 extending from housing 70. The housing 70 sealingly surrounds tube 14 and the blade assembly 58 so that all air drawn by the suction device passes through tubes 14 and 28, thereby creating the aforementioned brisk air flow that presents the material in the proper position and condition for cutting by blades 50. The air flow also helps to keep the fiber or film 44 from dragging on the bottom of feed conduit 28 and/or tube 14.

The multiple adjustments in apparatus 10, for example, angle "A", fine adjustment of tube 14 with adjusting ring 30 are parameters that address cutting consistency and effectiveness whereas speed of motor 54, number of blades 50, and speed with which the fiber or film 44 is passed through apparatus 10, address the cut length of the product.

What is claimed is:

1. A method of forming uniform lengths of cut fibers from lengths of filamentary material comprising the steps of, (a) aligning a first longitudinally movable tube and a second stationary tube along substantially the same axis, (b) surrounding adjacent ends of the first and second tubes with an adjusting ring having threads mating with threads on the adjacent ends of the first and second tubes, (c) aligning at least one rotating cutting blade for passage through a plane immediately adjacent an exit end of the first tube, (d) passing air through the tubes at a high velocity, (e) pneumatically conveying the filamentary material into and through the tubes to a point adjacent the plane through which the at least one rotating cutting blade passes; and (f) adjusting a distance between the exit end of the first tube and the at least one rotating cutting blade by rotating the adjusting ring.

2. The method of claim 1 adjusting a distance between an insert in the exit end of the first tube and the at least one rotating cutting blade by rotating the adjusting ring.

3. An apparatus for cutting filamentary material into uniform lengths comprising;

(a) a first, non-rotating tube having a central axis which is movable in a linear direction and having entrance and exit ends through which the filamentary material passes, (b) a second stationary tube adjacent the entrance end of the first tube, (c) an adjusting ring threadedly connecting to threaded portions of the first and second tubes, which ring, upon rotation, provides fine adjustment of the linear movement of the first tube, and (d) at least one cutting blade rotating in a plane substantially perpendicular to the axis of the first tube for cutting the filamentary material.

4. The cutting apparatus of claim 3 wherein a suction device is pneumatically connected to the exit end of the first tube creating a high velocity air flow through the tubes to transport filamentary material therethrough.

5. The cutting apparatus of claim 4, wherein a housing surrounding the cutting blades pneumatically connects the suction device and exit end of the first tube.

6. The cutting apparatus of claim 3 wherein the threads on the first and second tubes have a different pitch.

7. The cutting apparatus of claim 3 wherein the adjustment ring contains threads thereon matching the threads on the first and second tubes.

8. The cutting apparatus of claim 7 wherein a 10° rotation of the adjustment ring moves the first tube a linear distance of about one-ten thousands of an inch.

9. The cutting apparatus of claim 3 wherein the at least one cutting blade is mounted on a central hub and is adjustable about a longitudinal axis.

10. An apparatus for cutting filamentary material into uniform lengths comprising, (a) at least one first tube having a central axis, which is movable in a linear direction and having entrance and exit ends through which the filamentary material passes, (b) at least one second tube adjacent the first tube;

(c) at least one adjustment ring threadedly connecting to threaded portions of the first and second tubes which, upon rotation, provides fine adjustment of the linear movement of the first tube, (d) at least one cutting blade rotating in a plane substantially perpendicular to the central axis of the at least one first tube and in close proximity to the exit end of the at least one first tube for cutting the filamentary material.

11. The cutting apparatus of claim 10 wherein a cutting edge of the at least one blade has grazing contact with the exit end of the at least one first tube.

12. The cutting apparatus of claim 10 wherein the exit end of the first tube has an inwardly tapered surface adjacent the exit end where the at least one cutting blade approaches the at least one first tube and a substantially vertical surface extending over a portion of the exit end of the at least one first tube.

13. The cutting apparatus of claim 12 wherein the substantially vertical surface on the exit end of the at least one first tube is oriented at an angle to an edge of the at least one cutting blade.

14. The cutting apparatus of claim 10 wherein the at least one first tube includes a tapered insert at the exit end thereof.

15. The cutting apparatus of claim 14 wherein the insert contains a surface extending beyond the exit end of the at least one first tube.

16. The cutting apparatus of claim 15 wherein the surface of the insert is oriented at an angle to an edge of the at least one cutting blade.

17. The cutting apparatus of claim 16 wherein the angle is 3-10°.

* * * * *